US006901871B1

(12) United States Patent
Kronenberger

(10) Patent No.: US 6,901,871 B1
(45) Date of Patent: Jun. 7, 2005

(54) BOBBIN CASE ASSEMBLY WITH THREAD TENSIONING ELEMENT AND METHOD OF DRAWING THREAD FROM A THREAD SUPPLY

(76) Inventor: Ronald Kronenberger, 320 Portwine Rd., Riverwoods, IL (US) 60015

( * ) Notice: Subject to any disclaimer, the term of this patent is extended or adjusted under 35 U.S.C. 154(b) by 0 days.

(21) Appl. No.: 10/725,066

(22) Filed: Dec. 1, 2003

(51) Int. Cl.[7] ..... D05B 63/00
(52) U.S. Cl. ..... 112/229; 112/254
(58) Field of Search ..... 112/231, 228, 112/229, 230, 185, 188, 189, 196; 242/159, 332.7, 334, 358.1

(56) References Cited

U.S. PATENT DOCUMENTS 2,379,882 A * 7/1945 Clark ..... 112/196
2,892,428 A * 6/1959 Zylbert ..... 112/231
2,973,920 A * 3/1961 Kucmerosky ..... 242/130.2
4,679,513 A * 7/1987 Druffel ..... 112/229
6,152,057 A 11/2000 Badillo

* cited by examiner

*Primary Examiner*—Ismael Izaguirre
(74) *Attorney, Agent, or Firm*—Wood, Phillips, Katz, Clark & Mortimer

(57) ABSTRACT

A bobbin case assembly having a wall structure mountable upon a support, a bobbin for a supply of thread, and a tensioning element for engaging thread projecting from a supply of thread on the bobbin. The tensioning element has a length and a circumferential surface against which thread can be wrapped so that a frictional resistance force can be generated between the thread and circumferential surface that resists drawing of thread off of the supply. The tensioning element has a configuration that limits lengthwise shifting of a spirally wrapped portion of thread wrapped against the circumferential surface.

23 Claims, 6 Drawing Sheets

FIG. 6
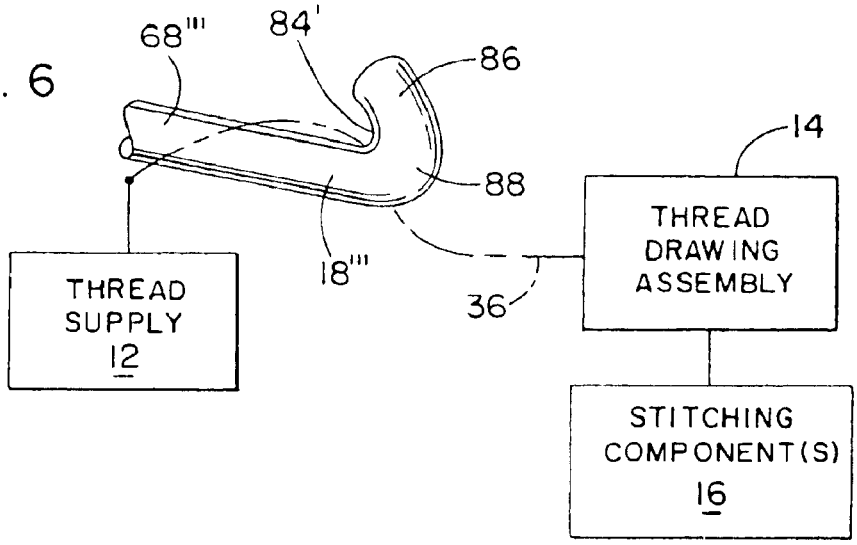
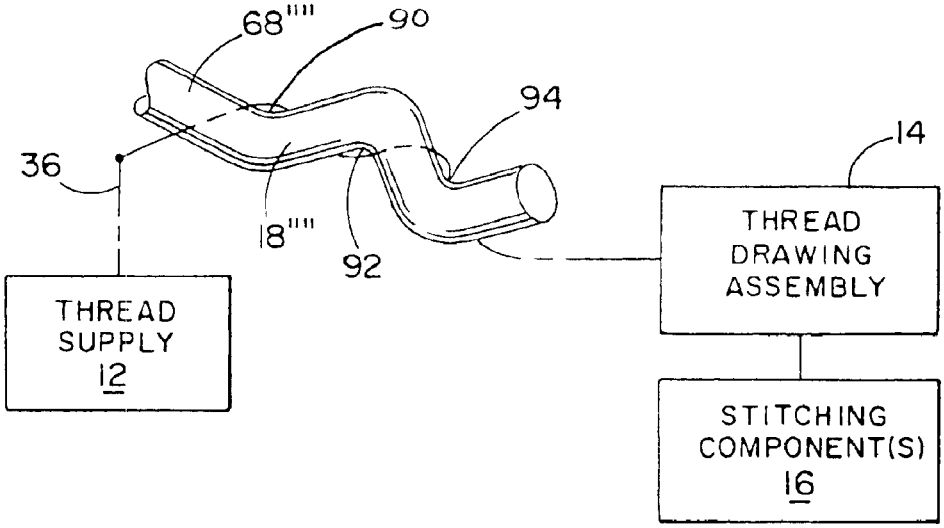
FIG. 7
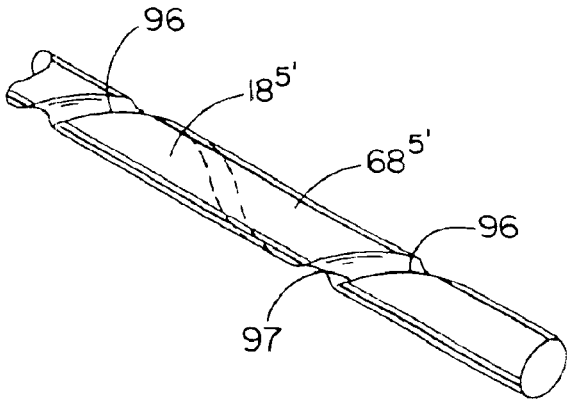
FIG. 8

BOBBIN CASE ASSEMBLY WITH THREAD TENSIONING ELEMENT AND METHOD OF DRAWING THREAD FROM A THREAD SUPPLY

BACKGROUND OF THE INVENTION

1. Field of the Invention

This invention relates to stitching systems utilizing a bobbin case assembly from which a stored supply of thread is drawn and, more particularly, to a bobbin case assembly having an associated thread tensioning element against which the thread paying off of the supply acts to produce controlled resistance to the payout of thread from the supply.

2. Background Art

In sewing/stitching operations, and particularly in embroidery operations, the tension of two source components forming the lockstitch needle thread and bobbin thread must balance to achieve a high quality stitch. If the tension in the needle thread is significantly greater than the bobbin thread tension, the bobbin thread can be pulled from through the underside of the fabric and show at the top side of the fabric being sewn. This condition can cause puckering of the fabric or disfigured sewing to occur. If the needle thread tension is significantly less than the bobbin thread tension, loops can form on either side of the fabric and the stitching formation can appear loose or distortedly large.

A primary job of a sewing equipment operator is to keep bobbin and needle thread tensions as close as possible to balanced. The method of balancing thread tension has historically been carried out by having the sewing operator observe the pattern after stitches are laid down. Good sewing operators constantly adjust the tension of both needle and bobbin threads to maintain the proper balance. Less skilled operators may not consistently maintain this balance as a result of which poor quality stitch formation may result.

The assignee herein is the owner of U.S. Pat. No. 6,152,057, which is directed to a bobbin case assembly with an associated tensioning element having a circumferential surface about which thread is wrapped to controllably increase thread draw tension. During setup, the sewing equipment operator can control the degree of wrapping of the thread around the tensioning element to thereby select the desired thread draw tension associated with that bobbin case assembly. This potentially obviates complex and time consuming adjustment procedures used in conventional sewing systems, which may incorporate a large number of sewing "heads". While the system disclosed in U.S. Pat. No. 6,152,057 represents a tremendous contribution to the industry, there are some inherent limitations associated therewith.

First of all, in the event that a significant increase in draw tension is required, multiple wraps of the thread around the tensioning element may be required. This results in a spiral arrangement of the thread around the tensioning element. The spiral pattern of the wrapped thread may shift during operation relative to the tensioning element, which may result in an appreciable draw tension variation.

The industry continues to seek out ways to predictably select draw tensions, maintainable at or close to a desired value, without complicated setup procedures or excessive adjustment as the system is monitored both at start-up and during use.

SUMMARY OF THE INVENTION

In one form, the invention is directed to a bobbin case assembly having a wall structure mountable upon a support, a bobbin for a supply of thread, and a tensioning element for engaging thread projecting from a supply of thread on the bobbin. The tensioning element has a length and a circumferential surface against which thread can be wrapped so that a frictional resistance force can be generated between the thread and circumferential surface that resists drawing of thread off of the supply. The tensioning element has a configuration that limits lengthwise shifting of a spirally wrapped portion of thread wrapped against the circumferential surface.

In one form, the tensioning element has an edge to which thread can abut to limit lengthwise shifting of a spirally wrapped portion of thread wrapped around the circumferential surface.

In one form, the tensioning element has an elongate body and the edge is defined by a bend in the elongate body.

In one form, the edge is defined by a projection from the circumferential surface.

The edge may be defined by an undercut in the circumferential surface.

In one form, the body has a diameter and a first diameter portion and a second diameter portion. The edge is defined at a juncture between the first diameter portion and the second diameter portion.

In another form, the body has an angled portion at which the edge is defined.

The edge may alternatively be defined by texturing the circumferential surface.

In one form, the circumferential surface is defined on a body portion having a length with a diameter, a first end, and a second end. The diameter of the body portion increases between the first end and the second end so that thread is spirally wrapped against the circumferential surface is limited against lengthwise shifting between the first and second ends of the body portion.

In one form, the tensioning element has a plurality of edges to which thread can abut to limit lengthwise shifting of thread spirally wrapped against the circumferential surface.

The invention is further directed to the combination of a) a bobbin case assembly having a wall structure mountable upon a support, a bobbin, and a supply of thread wrapped on the bobbin, and b) a thread drawing assembly for exerting a tension on the thread to draw the thread from the supply. The bobbin case assembly further has a tensioning element with a length and a circumferential surface. The thread extends from the supply and is wrapped against and at least partially around the circumferential surface so that a frictional resistance force is generated between the thread and circumferential surface that resists drawing of the thread off of the supply. The tensioning element has a configuration that limits lengthwise shifting of a spirally wrapped portion of thread wrapped against the circumferential surface.

In one form, the tensioning element has an edge to which the thread can abut to limit lengthwise shifting of the spirally wrapped portion of thread wrapped against the circumferential surface.

In one form, the tensioning element has an elongate body and the edge is defined by a bend in the elongate body.

The edge may be defined by a projection from the circumferential surface.

In another form, the edge is defined by an undercut in the circumferential surface.

In one form, the tensioning element has a body with a diameter and a first diameter portion and second diameter portion. The edge is defined at a juncture between the first diameter portion and the second diameter portion.

In one form, the body has an angled portion at which the edge is defined.

In another form, the edge is defined by texturing the circumferential surface.

In one form, the circumferential surface is defined on a body portion having a length with a diameter, a first end, and a second end. The diameter of the body portion increases between the first and the second ends so that thread spirally wrapped against the circumferential surface is limited against lengthwise shifting between the first and second ends of the body portion.

The combination may further include at least one component for stitching using thread drawn from the supply by a thread drawing assembly.

The combination may further include a support to which the wall structure is mounted.

In one form, the tensioning element has a plurality of edges to which the thread abuts to limit lengthwise shifting of thread spirally wrapped against the circumferential surface.

The invention is further directed to a method of drawing thread from a supply of the thread that is wrapped around a bobbin. The method includes the steps of: providing a tensioning element on a body having a portion with a length and a circumferential surface; wrapping the thread against the circumferential surface so as to form a spiral portion of thread that is wrapped against the circumferential surface so that a frictional resistance force is generated between the thread and circumferential surface that resists drawing of thread off of the supply; exerting a tensioning force on the thread to cause the thread to be drawn off of the bobbin; and causing the spirally wrapped portion to be limited in lengthwise shifting relative to the portion of the body as the thread is drawn off of the bobbin.

BRIEF DESCRIPTION OF THE DRAWINGS

FIG. 6 is a view as in FIG. 3 of a further modified form of tensioning element, according to the present invention, with a thread controlling edge defined by a hooked end;

FIG. 7 is a view as in FIG. 4 of a still further modified form of tensioning element, according to the present invention, with thread controlling edges defined by a plurality of bends in the tensioning element;

FIG. 8 is a fragmentary, perspective view of a still further modified form of tensioning element, according to the present invention, with a thread controlling edge defined by a spiral undercut;

DETAILED DESCRIPTION OF THE DRAWINGS

Figure 1:
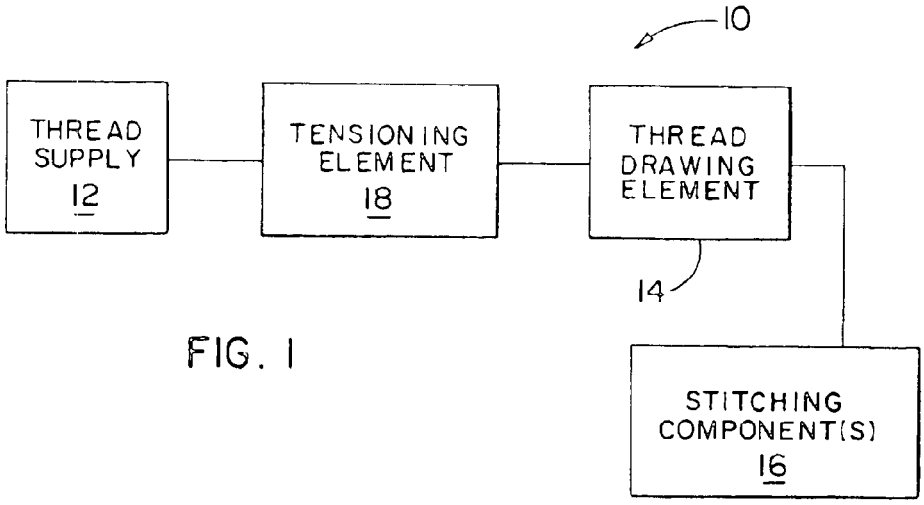
FIG. 1 is a schematic representation of a sewing system with a tensioning element, according to the present invention, incorporated therein.

In FIG. 1, an exemplary sewing system is shown at 10, representing an exemplary environment for the present invention. The sewing system 10 consists of a thread supply 12, with the thread pulled out by a thread drawing assembly 14 from the thread supply 12. The drawn thread is processed conventionally using one or more stitching components 16 to generate a desired stitching pattern. The nature of the stitching is not critical to the present invention. The invention is focused on a tensioning element 18 which cooperates with thread from the supply 12 to produce a frictional force that resists drawing of thread from the supply 12. The manner of storing the thread to allow its withdrawal is not critical to the present invention, nor is the manner in which the thread is tensioned and drawn off by the thread drawing assembly 14. Further details of an exemplary sewing system 10 are shown in FIG. 2.

Figure 2:
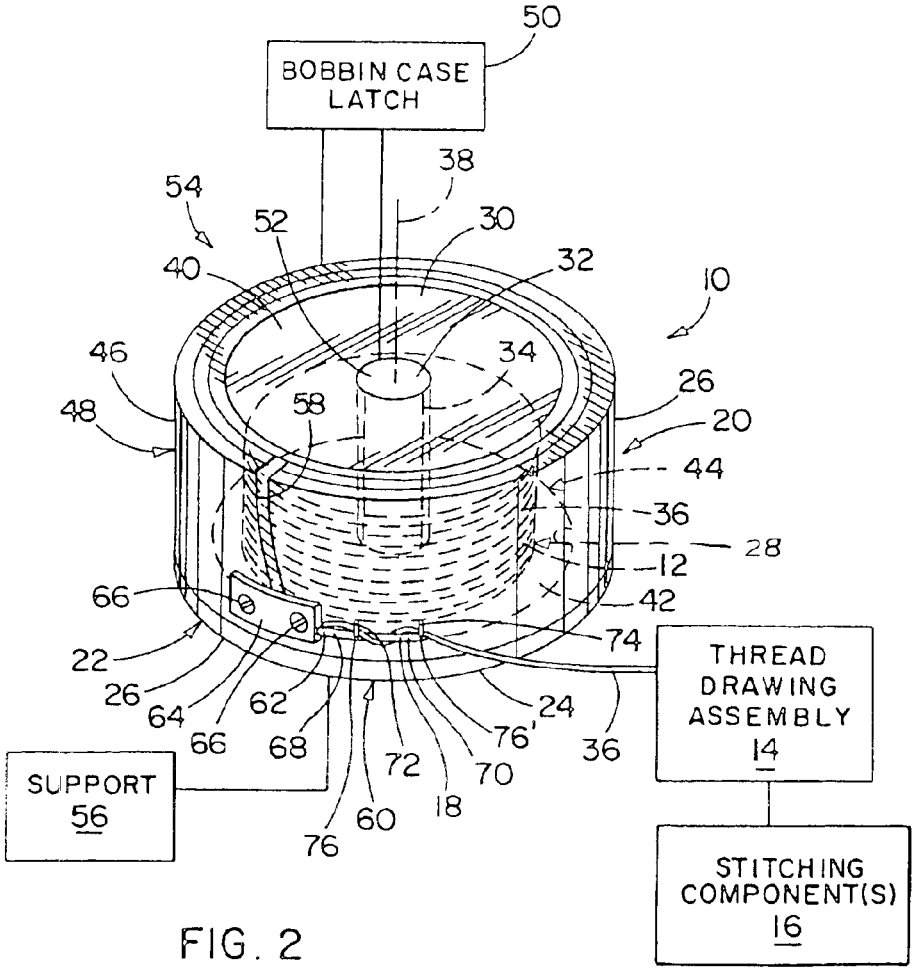
FIG. 2 is a partially schematic representation of the sewing system in FIG. 1 and with a perspective view of a bobbin case assembly incorporating one form of thread tensioning element, according to the present invention, and having a peripheral surface around which thread is spirally wrapped and limited in shifting lengthwise by edges defined by two spaced projections from the peripheral surface.

In FIG. 2, the thread supply 12 is provided within a bobbin case assembly at 20. The bobbin case assembly 20 consists of a bobbin basket assembly at 22, which has a bottom wall 24 and an annular, peripheral wall 26 extending upwardly therefrom, and defining in conjunction therewith, a receptacle 28 for a bobbin 30. A cylindrical post 32 projects upwardly from the bottom wall 24 and through a core 34 on the bobbin 30 around which thread 36 from the supply 12 is wrapped. The post 32 guides movement of the bobbin 30 in rotation around an axis 38. Axially spaced flanges 40, 42, at the end of the core 34, cooperatively bound a storage space at 44 for the thread supply 12.

A bobbin case 46 has a peripheral wall at 48 which surrounds the bobbin 30. A latch 50 on the bobbin case 46 releasably connects to the end 52 of the post 32 portion that is exposed through the bobbin 30, to releasably connect the bobbin case 46 to the bobbin basket assembly 22.

The bobbin case 46 and bobbin basket assembly 22 cooperatively define a wall structure at 54 that is mounted conventionally upon a support 56. With the wall structure 54 suitably mounted, the thread 36 from the supply 12 is directed through the wall structure 54 to be engaged by the thread drawing assembly 14. The thread 36 from the supply 12 is directed radially outwardly through an opening 58 in the wall structure 54 to be exposed for engagement by the thread drawing assembly 14. A thread tensioning assembly at 60, incorporating the tensioning element 18, is interposed between the supply 12 and thread drawing assembly 14 to variably control the operative thread draw tension.

The tensioning element 18 has a mounting end 62 which is captively maintained on the wall structure 54 through a mounting plate 64. The mounting plate 64 is maintained in place on the wall structure 54 through spaced fasteners 66. The thread tensioning element 18 has an elongate body 68, as seen also in FIG. 3. The body 68 has a peripheral surface 70 against which the thread 36 is placed to produce a controlled frictional resistance force. The basic structure to accomplish this is shown in U.S. Pat. No. 6,152,057, which is incorporated herein by reference.

Figure 3:
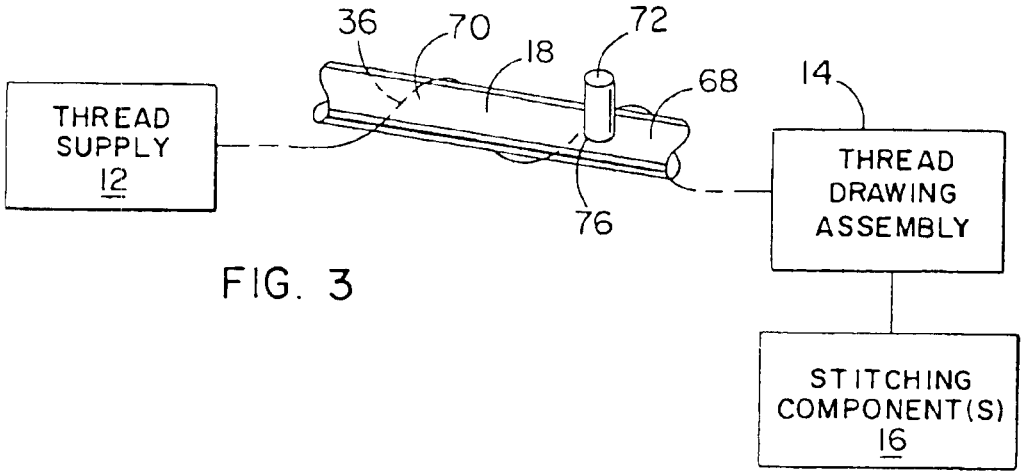
FIG. 3 is a partially schematic representation of the sewing system in FIG. 1 with an enlarged, fragmentary, perspective view of the tensioning element in FIG. 2.

In a typical operation, the thread 36 will be wrapped to produce at least a portion of a spiral which bears upon the surface 70. As shown in FIGS. 2 and 3, the thread 36 is wrapped to extend completely around the peripheral surface 70 of the body 60 in a spiral pattern. The thread path on the tensioning element 18 in FIG. 3 is indicated by dotted lines. To avoid shifting of the spiral thread portions lengthwise of the body 68, projections 72, 74 are provided and extend away from the peripheral surface 70. In this case, each projection 72, 74 is substantially cylindrical in shape with an axis that projects orthogonally to the length of the body 68. As seen more clearly in FIG. 3, the projection 72 defines an edge 76 to which a spiral portion of the thread 36 abuts to limit lengthwise shifting of the spiral portion of the thread 36 thereat. The other projection 74 provides a like thread controlling edge 76' to engage another spiral portion of the thread 36 spaced lengthwise from the portion which engages the edge 76. The projections 72, 74 are preferably spaced lengthwise of the body 68 to correspond to the desired "rise" of the spirally wrapped thread 36, to engage preferably adjacent wrapped turns thereof. Accordingly, a spiral thread arrangement can be consistently maintained with respect to the length of the body 68 as the thread 36 continues to be drawn off of the supply 12.

The invention contemplates many different ways to limit lengthwise shifting of spirally wrapped thread portions with respect to an elongate portion of a body. In one variation (not shown), the projections 72, 74 can be circumferentially offset so as not to reside in a line, as shown in FIGS. 2 and 3.

Figure 4:
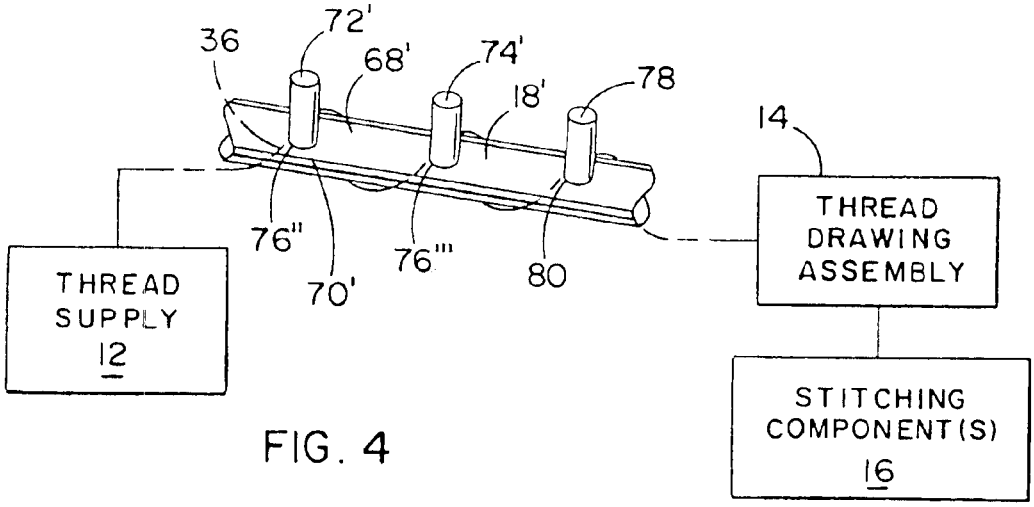
FIG. 4 is a view as in FIG. 3 with a modified form of tensioning element, according to the present invention, including three projections defining thread controlling edges.

In FIG. 4, a modified tensioning element 18' is shown wherein three projections 72', 74', 78 from the peripheral surface 70' of the body 68 are utilized. This produces three spaced edges 76', 76", 80 against which spiral portions can abut.

Figure 5:
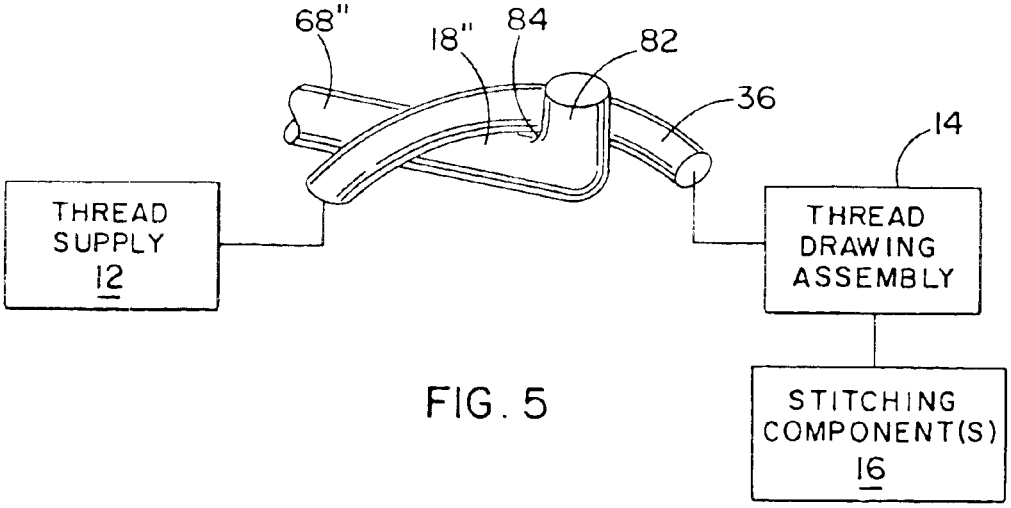
FIG. 5 is a view as in FIG. 3 of a further modified form of tensioning element, according to the present invention, with a thread controlling edge defined by a bent end.

In FIG. 5, a modified form of tensioning element is shown at 18" with an elongate body 68" having an offset end 82 defining a thread engaging/controlling edge 84. The edge 84 serves the same purpose as the edges 76, 76', 76", 76'". The angled end 82 may be formed by bending or preformed in the configuration shown.

A modification of the FIG. 5 design is shown on a tensioning element 18" in FIG. 6 wherein a body 68'" has a return bend 86 with a bight portion 88 defining a thread engaging edge 84'.

In FIG. 7, a modified form of thread tensioning element is shown at 18"". The tensioning element 18"" has a body 68"" that is angled/bent or preformed in a zig-zag manner to produce edges 90, 92, 94, to bear against the thread 36 to maintain the controlled spiral wrapping pattern therefor.

Figure 9:
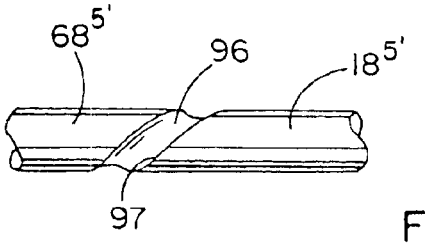
FIG. 9 is a fragmentary, side elevation view of the tensioning element in FIG. 8.

In FIGS. 8 and 9, a modified form of tensioning element $18^{5'}$ is shown with a body $68^{5'}$ with an undercut, spiral groove 96 corresponding to the intended spiral path for the thread 36. A continuous edge 97 bounding the groove 96 limits lengthwise shifting of the spiral turns of the thread 36.

Figure 10:
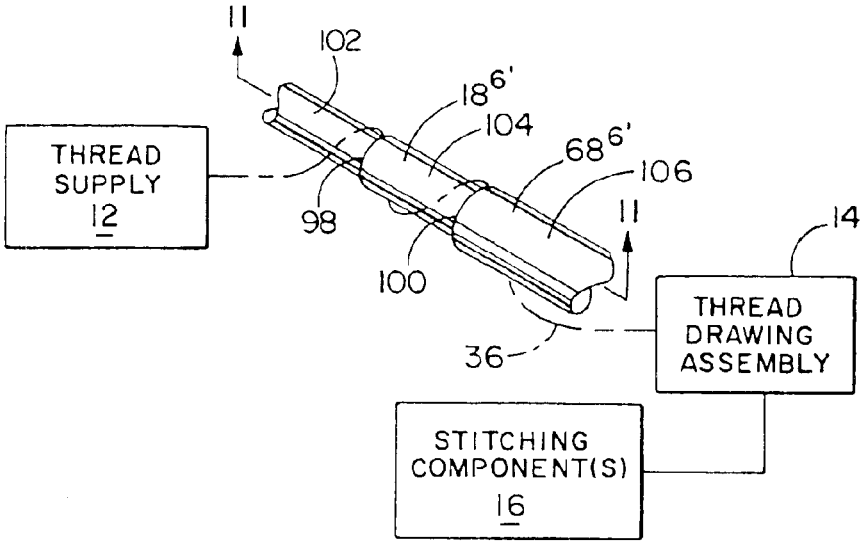
FIG. 10 is a view as in FIG. 3 of yet a further modified form of tensioning element, according to the present invention, with spaced thread controlling edges defined at the juncture of portions having different diameters.
Figure 11:
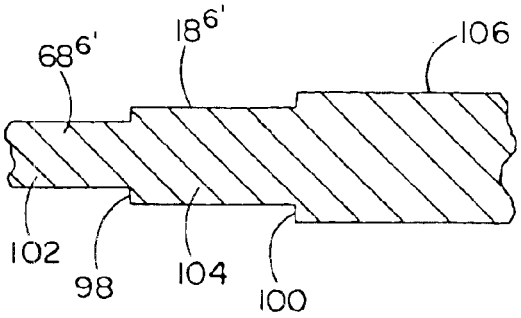
FIG. 11 is an enlarged, cross-sectional view of the tensioning element taken along line 11—11 of FIG. 10.

In FIGS. 10 and 11, a modified form of tensioning element is shown at $18^{6'}$ with a stepped diameter body $68^{6'}$. Thread engaging edges 98, 100 are defined respectively at the junctures between a) a first diameter portion 102 and a larger diameter portion 104 and b) the larger diameter portion 104 and a third portion 106 having a diameter larger than the portion 104. The thread 36 will hang up on the edges 98, 100, but is not as positively limited against lengthwise shifting by reason of the fact that the thread must cross over the edges in transitioning between the body portions 102, 104, 106.

Figure 12:
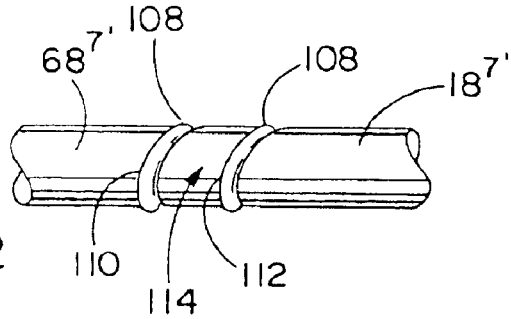
FIG. 12 is a view as in FIG. 9 of a further modified form of tensioning element, according to the present invention, with curved projections from the peripheral surfaces defining thread controlling edges.

In FIG. 12, a further modified form of tensioning element is shown at $18^{7'}$. The tensioning element $18^{7'}$ has a body $68^{7'}$ with curved projections 108, defining thread engaging edges 110, 112. Alternatively, the projections 108 can be close enough together so that they cooperatively define a receptacle at 114 that is slightly larger than the diameter of the thread 36 for purposes of consistently maintaining the thread 36 in a spiral pattern around the body $68^{7'}$.

Figure 13:
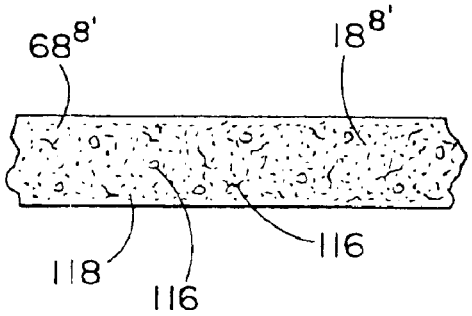
FIG. 13 is a view as in FIG. 12 of a still further modified form of tensioning element, according to the present invention, including texturing to define thread controlling edges.

In FIG. 13, individual projections 116 are regularly or randomly provided on a body $68^{8'}$ of a tensioning element $18^{8'}$ to produce edges 118 associated with the projections 116. The projections 116 may be formed by a texturing process that produces a roughened surface with significant contour on the body $68^{8'}$.

Figure 14:
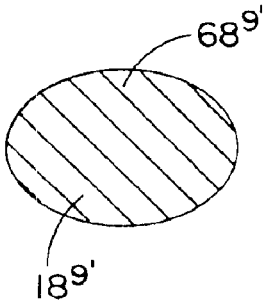
FIG. 14 is an enlarged, cross-sectional view of another modified form of thread tensioning element, according to the present invention, and having a body with a non-circular cross-sectional configuration.

While most of the embodiments for the tensioning element 18–$18^{8'}$, described above, have shown bodies 68–$68^{8'}$ with cylindrical cross sections, taken transversely to their lengths, other cross-sectional configurations are contemplated. As just an example, in FIG. 14, a tensioning element $18^{9'}$ is shown with a body $68^{9'}$ having an elliptical cross-sectional shape. Virtually any shape that defines a circumferential surface against which a spirally wrapped thread portion can be urged will suffice for purposes of the present invention.

Figure 15:
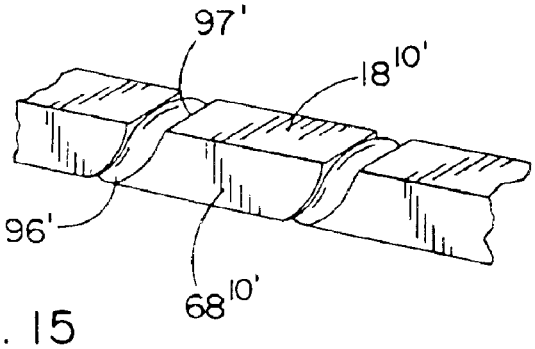
FIG. 15 is a view as in FIG. 8 of a further modified form of tensioning element, according to the present invention, wherein a squared body has an undercut groove defining a thread controlling edge.

In FIG. 15, a tensioning element $18^{10'}$ is shown with the body $68^{10'}$ that is generally squared with a continuous groove 96', corresponding to the groove 96 shown in FIGS. 8 and 9. The groove 96' defines a continuous thread engaging edge 97'.

Figure 16:
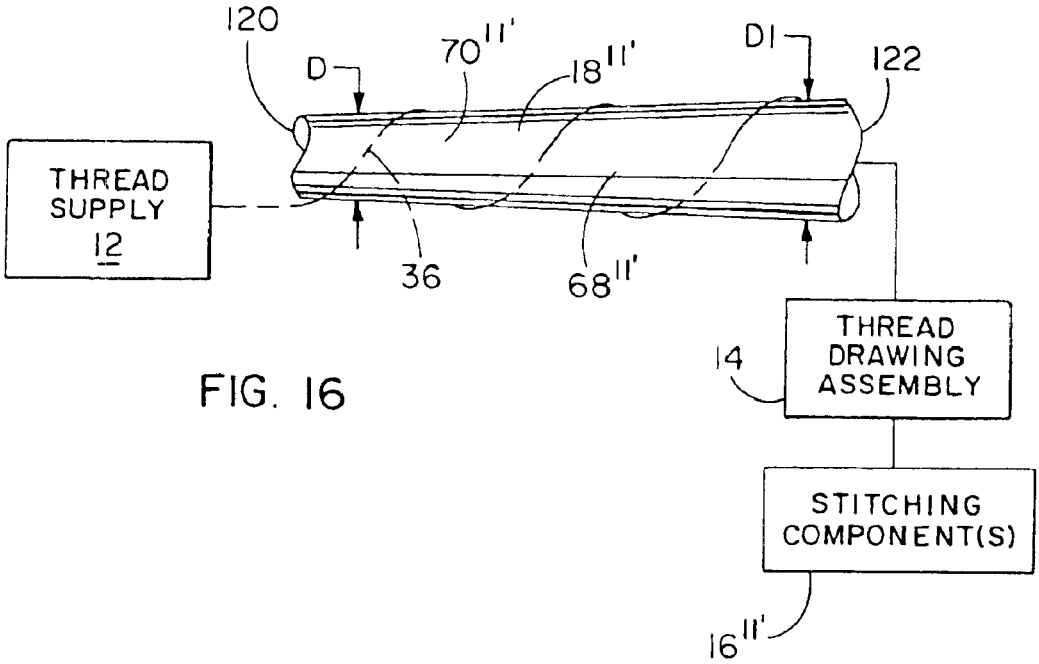
FIG. 16 is a partially schematic representation of the sewing system of FIG. 1 with a fragmentary, side elevation view of a further modified form of tensioning element, according to the present invention, and including a varying diameter body which limits thread shifting lengthwise thereof.

In FIG. 16, a further modified form of tensioning element $18^{11'}$, according to the present invention, shown with a body $68^{11'}$. The body $68^{11'}$ has a peripheral surface $70^{11'}$, with a diameter D at one location 120 and a diameter D1 at a spaced location 122. The diameter D1 is greater than the diameter D. The diameter may increase progressively between the locations 120, 122. As a result, the thread spirals are limited in lengthwise shifting by reason of the increasing diameter of the peripheral surface 70[11'. As the thread 36 wraps and is tightened towards the one location 120, the diameter of the spirals will not pass over the increasing diameter. Thus, the effect of a fixed edge is realized without any discrete edge formation.

Figure 17:
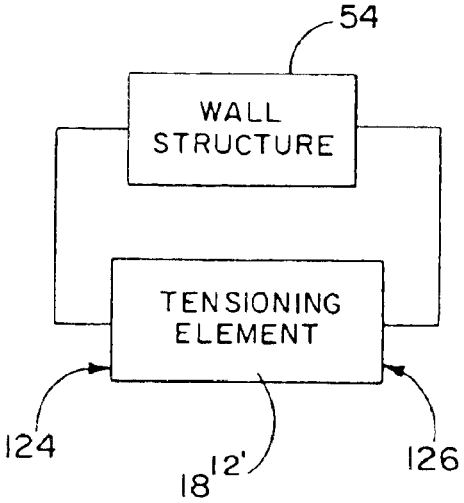
FIG. 17 is a schematic representation of a tensioning element, according to the present invention, mounted operably upon a wall structure.

The invention contemplates other variations. As shown in FIG. 17, a tensioning element 18[12'], representative of all of the tensioning elements heretofore described, as well as others that could be devised by those skilled in the art with the present teachings in hand, is shown with a mounting end 124 that is attached to the wall structure 54. The end 126 opposite to the end 124 is likewise attached to the wall structure 54. In other words, a cantilever mounting of the tensioning element 18[12'] is not required to practice the present invention.

The foregoing disclosure of specific embodiments is intended to be illustrative of the broad concepts comprehended by the invention.

What is claimed is:

1. A bobbin case assembly comprising:

a wall structure mountable upon a support;

a bobbin for a supply of thread; and a tensioning element for engaging thread projecting from a supply of thread on the bobbin;

the tensioning element having a length and a circumferential surface against which thread can be wrapped so that a frictional resistance force can be generated between the thread and the circumferential surface that resists drawing of thread off of the supply;

the tensioning element having a configuration that limits lengthwise shifting of a spirally wrapped portion of thread wrapped against the circumferential surface so as to controllably maintain a lengthwise space between adjacent turns of a spirally wrapped portion of thread wrapped against the circumferential surface.

2. The bobbin case assembly according to claim 1 wherein the tensioning element has an edge to which thread can abut to limit lengthwise shifting of a spirally wrapped portion of thread wrapped against the circumferential surface.

3. The bobbin case assembly according to claim 2 wherein the tensioning element has an elongate body and the edge is defined by a bend in the elongate body.

4. The bobbin case assembly according to claim 2 wherein the edge is defined by a projection from the circumferential surface.

5. The bobbin case assembly according to claim 2 wherein the tensioning element has a body and the body has an angled portion at which the edge is defined.

6. A bobbin case assembly comprising:

a wall structure mountable upon a support, a bobbin for a supply of thread, and a tensioning element for engaging thread projecting from a supply of thread on the bobbin, the tensioning element having a length and a circumferential surface against which thread can be wrapped so that a frictional resistance force can be generated between the thread and the circumferential surface that resists drawing of thread off of the supply, the tensioning element having a configuration that limits lengthwise shifting of a spirally wrapped portion of thread wrapped against the circumferential surface, wherein the tensioning element has an edge to which thread can abut to limit lengthwise shifting of a spirally wrapped portion of thread wrapped against the circumferential surface, wherein the edge is defined by an undercut in the circumferential surface.

7. A bobbin case assembly comprising:

a wall structure mountable upon a support, a bobbin for a supply of thread, and a tensioning element for engaging thread projecting from a supply of thread on the bobbin, the tensioning element having a length and a circumferential surface against which thread can be wrapped so that a frictional resistance force can be generated between the thread and the circumferential surface that resists drawing of thread off of the supply, the tensioning element having a configuration that limits lengthwise shifting of a spirally wrapped portion of thread wrapped against the circumferential surface, wherein the tensioning element has an edge to which thread can abut to limit lengthwise shifting of a spirally wrapped portion of thread wrapped against the circumferential surface, wherein the tensioning element has a body with a diameter, the body having a first diameter portion and a second diameter portion and the edge is defined at a juncture between the first diameter portion and the second diameter portion.

8. A bobbin case assembly comprising:

a wall structure mountable upon a support, a bobbin for a supply of thread, and a tensioning element for engaging thread projecting from a supply of thread on the bobbin, the tensioning element having a length and a circumferential surface against which thread can be wrapped so that a frictional resistance force can be generated between the thread and the circumferential surface that resists drawing of thread off of the supply, the tensioning element having a configuration that limits lengthwise shifting of a spirally wrapped portion of thread wrapped against the circumferential surface, wherein the tensioning element has an edge to which thread can abut to limit lengthwise shifting of a spirally wrapped portion of thread wrapped against the circumferential surface, wherein the edge is defined by texturing the circumferential surface.

9. A bobbin case assembly comprising:

a wall structure mountable upon a support, a bobbin for a supply of thread, and a tensioning element for engaging thread projecting from a supply of thread on the bobbin, the tensioning element having a length and a circumferential surface against which thread can be wrapped so that a frictional resistance force can be generated between the thread and the circumferential surface that resists drawing of thread off of the supply, the tensioning element having a configuration that limits lengthwise shifting of a spirally wrapped portion of thread wrapped against the circumferential surface, wherein the tensioning element has a body, the circumferential surface is defined on a body portion having a length with a diameter, a first end and a second end, and the diameter of the body portion increases between the first end and the second end so that thread spirally wrapped against the circumferential surface is limited against lengthwise shifting between the first and second ends of the body portion.

10. A bobbin case assembly comprising:

a wall structure mountable upon a support, a bobbin for a supply of thread, and a tensioning element for engaging thread projecting from a supply of thread on the bobbin, the tensioning element having a length and a circumferential surface against which thread can be wrapped so that a frictional resistance force can be generated between the thread and the circumferential surface that resists drawing of thread off of the supply, the tensioning element having a configuration that limits lengthwise shifting of a spirally wrapped portion of thread wrapped against the circumferential surface, wherein the tensioning element has a plurality of edges to which thread can abut to limit lengthwise shifting of thread spirally wrapped against the circumferential surface.

11. In combination:

a) a bobbin case assembly comprising:

a wall structure mountable upon a support;

a bobbin;

a supply of thread wrapped on the bobbin; and a tensioning element having a length and a circumferential surface;

the thread extending from the supply and wrapped against and at least partially around the circumferential surface so that a frictional resistance force is generated between the thread and circumferential surface that resists drawing of the thread off of the supply;

the tensioning element having a configuration that limits lengthwise shifting of a spirally wrapped portion of thread wrapped against the circumferential surface so as to controllably maintain a lengthwise space between adjacent turns of a spirally wrapped portion of thread wrapped against the circumferential surface; and b) a thread drawing assembly for exerting a tension on the thread to draw the thread from the supply.

12. The combination according to claim 11 wherein the tensioning element has an edge to which thread can abut to limit lengthwise shifting of a spirally wrapped portion of thread wrapped against the circumferential surface.

13. The combination according to claim 12 wherein the tensioning element has an elongate body and the edge is defined by a bend in the elongate body.

14. The combination according to claim 12 wherein the edge is defined by a projection from the circumferential surface.

15. The combination according to claim 12 wherein the tensioning element has a body and the body has an angled portion at which the edge is defined.

16. The combination according to claim 11 further in combination with at least one component for stitching using thread drawn from the supply by the thread drawing assembly.

17. The combination according to claim 16 further in combination with a support to which the wall structure is mounted.

18. In combination:

a) a bobbin case assembly comprising:

a wall structure mountable upon a support;

a bobbin;

a supply of thread wrapped on the bobbin; and a tensioning element having a length and a circumferential surface;

the thread extending from the supply and wrapped against and at least partially around the circumferential surface so that a frictional resistance force is generated between the thread and circumferential surface that resists drawing of the thread off of the supply;

the tensioning element having a configuration that limits lengthwise shifting of a spirally wrapped portion of thread wrapped against the circumferential surface; and b) a thread drawing assembly for exerting a tension on the thread to draw the thread from the supply;

wherein the tensioning element has an edge to which thread can abut to limit lengthwise shifting of a spirally wrapped portion of thread wrapped against the circumferential surface;

wherein the edge is defined by an undercut in the circumferential surface.

19. In combination:

a) a bobbin case assembly comprising:

a wall structure mountable upon a support;

a bobbin;

a supply of thread wrapped on the bobbin; and a tensioning element having a length and a circumferential surface;

the thread extending from the supply and wrapped against and at least partially around the circumferential surface so that a frictional resistance force is generated between the thread and circumferential surface that resists drawing of the thread off of the supply;

the tensioning element having a configuration that limits lengthwise shifting of a spirally wrapped portion of thread wrapped against the circumferential surface; and b) a thread drawing assembly for exerting a tension on the thread to draw the thread from the supply;

wherein the tensioning element has an edge to which thread can abut to limit lengthwise shifting of a spirally wrapped portion of thread wrapped against the circumferential surface;

wherein the tensioning element has a body with a diameter, the body having a first diameter portion and a second diameter portion and the edge is defined at a juncture between the first diameter portion and the second diameter portion.

20. In combination:

a) a bobbin case assembly comprising:

a wall structure mountable upon a support;

a bobbin;

a supply of thread wrapped on the bobbin; and a tensioning element having a length and a circumferential surface;

the thread extending from the supply and wrapped against and at least partially around the circumferential surface so that a frictional resistance force is generated between the thread and circumferential surface that resists drawing of the thread off of the supply;

the tensioning element having a configuration that limits lengthwise shifting of a spirally wrapped portion of thread wrapped against the circumferential surface; and b) a thread drawing assembly for exerting a tension on the thread to draw the thread from the supply;

wherein the tensioning element has an edge to which thread can abut to limit lengthwise shifting of a spirally wrapped portion of thread wrapped against the circumferential surface;

wherein the edge is defined by texturing the circumferential surface.

21. In combination:

a) a bobbin case assembly comprising:

a wall structure mountable upon a support;

a bobbin;

a supply of thread wrapped on the bobbin; and a tensioning element having a length and a circumferential surface;

the thread extending from the supply and wrapped against and at least partially around the circumferential surface so that a frictional resistance force is generated between the thread and circumferential surface that resists drawing of the thread off of the supply;

the tensioning element having a configuration that limits lengthwise shifting of a spirally wrapped portion of thread wrapped against the circumferential surface; and b) a thread drawing assembly for exerting a tension on the thread to draw the thread from the supply;

wherein the circumferential surface is defined on a body portion having a length with a diameter, a first end and a second end, and the diameter of the body portion increases between the first end and the second end so that thread spirally wrapped against the circumferential surface is limited against lengthwise shifting between the first and second ends of the body portion.

22. In combination:

a) a bobbin case assembly comprising:

a wall structure mountable upon a support;

a bobbin;

a supply of thread wrapped on the bobbin; and a tensioning element having a length and a circumferential surface;

the thread extending from the supply and wrapped against and at least partially around the circumferential surface so that a frictional resistance force is generated between the thread and circumferential surface that resists drawing of the thread off of the supply;

the tensioning element having a configuration that limits lengthwise shifting of a spirally wrapped portion of thread wrapped against the circumferential surface; and b) a thread drawing assembly for exerting a tension on the thread to draw the thread from the supply;

wherein the tensioning element has an edge to which thread can abut to limit lengthwise shifting of a spirally wrapped portion of thread wrapped against the circumferential surface;

wherein the tensioning element has a plurality of edges to which the thread abuts to limit lengthwise shifting of thread spirally wrapped against the circumferential surface.

23. A method of drawing thread from a support for the thread wrapped around a bobbin, said method comprising the steps of:

providing a tensioning element with a body having a portion with a length and a circumferential surface;

wrapping the thread against the circumferential surface so as to form a spiral portion of thread that is wrapped against the circumferential surface so that a frictional resistance force is generated between the thread and circumferential surface that resists drawing of thread off of the supply;

exerting a tensioning force on the thread to cause the thread to be drawn off of the bobbin; and causing the spirally wrapped portion to be limited in lengthwise shifting relative to the portion of the body as the thread is drawn off of the bobbin so that a lengthwise space is controllably maintained between adjacent turns of the spirally wrapped portion of the thread.

* * * * *